United States Patent [19]

Houlachi et al.

[11] Patent Number: 5,019,172

[45] Date of Patent: May 28, 1991

[54] CHEMICAL TREATMENT OF ALUMINUM CATHODES IN ZINC ELECTROWINNING

[75] Inventors: George Houlachi, Kirkland; Terry J. Murphy, Pierrefonds; Jean-Pierre St-Onge, Valleyfield; Daniel Daoust, Ormstown, all of Canada

[73] Assignee: Noranda Inc., Toronto, Canada

[21] Appl. No.: 516,929

[22] Filed: Apr. 30, 1990

[30] Foreign Application Priority Data

May 1, 1989 [CA] Canada ..... 598398

[51] Int. Cl.[5] ..... C23G 1/02

[52] U.S. Cl. ..... 134/3; 134/41; 204/114; 156/665; 156/292

[58] Field of Search ..... 204/59 M, 114, 292; 134/3, 41; 156/665

[56] References Cited

U.S. PATENT DOCUMENTS

| | | | |
|---|---|---|---|
| 1,255,433 | 2/1918 | Laist et al. | 204/114 |
| 1,839,488 | 1/1932 | Mason | 134/41 |
| 2,650,901 | 9/1953 | van der Horst | 134/3 |

*Primary Examiner*—John F. Niebling
*Assistant Examiner*—Kathryn Gorgos
*Attorney, Agent, or Firm*—Fleit, Jacobson, Cohn, Price, Holman & Stern

[57] ABSTRACT

A chemical treatment of an aluminum cathode used in zinc electrowinning consists of contacting the affected areas of the aluminum cathode or the entire surface of the cathode with a dilute hydrochloric acid aqueous solution.

5 Claims, No Drawings

CHEMICAL TREATMENT OF ALUMINUM CATHODES IN ZINC ELECTROWINNING

BACKGROUND OF THE INVENTION

1. Field of the Invention

This invention relates to a method of chemical treating aluminum cathodes used in zinc electrowinning to remove recrystallized particles of zinc sulphate salts, and other impurities which may affect the zinc deposition process.

2. Description of the Related Art

During the zinc electrowinning process, zinc is plated onto aluminum cathodes while oxygen is evolved at the Pb-Ag anode. The zinc deposit is stripped from the cathode after a predetermined plating period which depends on the mode of operation of the zinc plant. The stripping process consists of removing the aluminum cathodes from the cells, followed by either manually or automatically stripping the zinc deposit. When the cathodes are removed from the cells and stripped, some electrolyte remains on the surface of the cathodes despite the water rinsing treatment. As a result, the cathodes especially in the area close to the edges of the cathode, is corroded at a varying degree, depending on the quantity and concentration of the acid in contact with the cathode. Evaporation of the electrolyte is also observed at the surface of cathode, resulting in precipitation of insoluble zinc sulphate salts and other impurities causing an increase in the corrosion rate of the aluminum cathode. The overall effect of this corrosion attack can be seen on the smoothness of the aluminum cathode, i.e., patches of rough areas appear at times on the surface of the aluminum. Because of the unevenness in the surface of the cathode and of the presence of impurities, the zinc deposition process is affected resulting in formation of rough zinc deposits. Usually, these areas are seen as "puffed" sections of the deposits which, because of their closer proximity to the anode, tend to affect the current distribution in the electrolysis cell. As the zinc electrowinning process is sensitive to variations in current density, the uneven current distribution observed with puffed zinc deposits, causes a decrease in the current efficiency of zinc deposition. Under these conditions, higher corrosion rates of the Pb-Ag anode are observed which result in an increase in the Pb content of the zinc deposits.

Another effect of the impurities on the surface of the aluminum cathode is the formation of pinholes on the zinc deposit. This also results in lower current efficiency of zinc deposition.

A known method of preventing the occurrence of puffed zinc deposits consists of mechanically or manually buffing the aluminum cathodes using metal or plastic brushes. Mechanical buffing is carried out using automated machines which apply a scrubbing action at the surface of the cathode. As a result the surface of the cathode is maintained free of deposited impurities. However, due to the presence of edge strips located at the sides and bottom of the aluminum cathode to prevent electrodeposition of zinc on the sides of the cathode and facilitate the stripping of the deposits, the mechanical buffing machines are not efficient in treating the entire surface of the cathode. Furthermore, mechanical or manual buffing of the affected cathodes does not completely remove the deposited impurities, and insoluble zinc sulphate salts from the surface of the electrode as the treated areas become affected after about three weeks necessitating rebuffing of the electrode.

To facilitate removal of impurities and insoluble zinc sulphate salts from an aluminum cathode used in zinc electrowinning a chemical treatment has been developed.

SUMMARY OF THE INVENTION

The chemical treatment in accordance with the present invention consists of contacting the affected areas of the aluminum cathode or the entire surface of the cathode with a dilute hydrochloric acid aqueous solution. The concentration of the hydrochloric acid solution is preferably between 2 and 10% HCl, and most preferably about 5% HCl. Higher concentrations of HCl in the aqueous solution may be used but did not significantly improve the efficiency of the chemical treatment.

The aluminum cathodes may be subsequently rinsed with water to remove excess chloride ions.

The above treatment results in removal of the insoluble zinc sulphate particles, and restores the condition of the aluminum cathode. These particles were found by x-ray analysis to be composed primarily of zinc sulphate salts.

DESCRIPTION OF THE PREFERRED EMBODIMENTS

To determine the efficiency of the chemical treatment, laboratory scale tests were conducted by comparing the electrochemical potentials without applying current, of affected (corroded aluminum) cathodes, samples with intact cathodes, new cathodes, and affected cathodes that had been treated for 1 minute with 2% HCl, 5% HCl, 10% HCl, 20% HCl, 20% $(NH_4)_2S_2O_8$, 5% $H_2O_2$, and 20% $H_2O_2$, respectively, followed by rinsing with water. The results of these tests are summarized in Table I.

TABLE I

Effect of Chemical Treatment on the Aluminum Cathode Rest Potential vs. $Hg/Hg_2SO_4$

| Condition of Cathode | Cathode Treatment | Rest potential (mV) |
|---|---|---|
| New | none | 1.08 |
| Intact | none | 1.09 |
| Affected | none | 0.85 |
| Affected | 2% HCl | 1.06 |
| Affected | 5% HCl | 1.07 |
| Affected | 10% HCl | 1.10 |
| Affected | 20% HCl | 1.11 |
| Affected | 20% $(NH_4)_2S_2O_8$ | 0.82 |
| Affected | 5% $H_2O_2$ | 0.90 |
| Affected | 20% $H_2O_2$ | 0.78 |

These results indicate that it is possible to treat an affected cathode with more than 2%, preferably 5% HCl and restore its initial state as compared with that of a new or intact aluminum cathode.

These findings were verified in actual electrolysis tests as shown in the following examples.

EXAMPLE 1

Test conditions: 0.6 A cell, 600 $A/m^2$

Electrodes: Affected aluminum

| Treatment | Electrolysis time hours | Current efficiency % |
|---|---|---|
| none | 24 | 85.8 |

-continued

| Treatment | Electrolysis time hours | Current efficiency % |
|---|---|---|
| 5% HCl | 24 | 91.5 |

The difference in current efficiency of 5.7% between these two means was found to be statistically significant at a 99% confidence level, based on testing 25 samples of affected (puffed) cathode and 11 samples of treated cathode. Results of x-ray analysis of the treated cathode showed no presence of crystallized particles of zinc sulphate salts or other impurities.

EXAMPLE 2

Test Conditions: Full scale plant tests
Electrodes: Affected aluminum
Treatment 5% HCl

| Test # | Current efficiency % | |
|---|---|---|
| | Before Treatment | After treatment |
| 1 | 91.6 | 92.6 |
| 2 | 90.0 | 92.0 |
| 3 | 90.9 | 93.7 |

The test duration for the above tests was 10 days.

Major advantages of the treatment in accordance with the present invention are: (1) the treatment effect is prolonged when compared to the mechanically or manually buffed cathodes (2 months versus 3 weeks), (2) the treatment can be made on site of the electrolytic bath, thus eliminating the need for additional manipulation of the cathodes, (3) the entire surface of the cathode can be subjected to the chemical treatment as compared to the limitation experienced with the mechanical buffing in reaching the edge of the cathode next to the permanent plastic edge strips (4) the current efficiency for zinc deposition is increased by up to 2.8%, (5) a decrease in the Pb content of the zinc deposits can be realized as the morphology of the zinc deposits is improved by chemically treating the aluminum cathode, and (6) the operational life of the Pb-Ag anode will be extended as the current distributions in the electrolysis cell is improved.

We claim:

1. A process for chemically treating an aluminum cathode having at least one affected area on a surface thereof as a result of using said aluminum cathode in zinc electrowinning, said process comprising contacting at least said affected area of the surface of said aluminum cathode with a dilute hydrochloric acid aqueous solution, wherein said dilute hydrochloric acid aqueous solution contains no additives, and wherein no current is applied to said aluminum cathode while contacting at least said affected area of the surface of said aluminum cathode with said dilute hydrochloric acid aqueous solution.

2. A process for chemically treating an aluminum cathode as defined in claim 1, wherein the concentration of the hydrochloric acid aqueous solution is between 2 and 10% HCl.

3. A process for chemically treating an aluminum cathode as defined in claim 2, wherein the concentration of the hydrochloric acid aqueous solution is about 5% HCl.

4. A process for chemically treating an aluminum cathode as defined in claim 1, further comprising rinsing the aluminum cathode with water to remove excess chloride ions.

5. A process for chemically treating an aluminum cathode as defined in claim 1, wherein the entire surface of said aluminum cathode is contacted with said dilute hydrochloric acid aqueous solution.

* * * * *